US008364029B2

(12) United States Patent
Chen

(10) Patent No.: US 8,364,029 B2
(45) Date of Patent: Jan. 29, 2013

(54) STEAM GENERATOR

(76) Inventor: Hsi-Fu Chen, Changhua County (TW)

( * ) Notice: Subject to any disclaimer, the term of this patent is extended or adjusted under 35 U.S.C. 154(b) by 328 days.

(21) Appl. No.: 12/833,513

(22) Filed: Jul. 9, 2010

(65) Prior Publication Data

US 2011/0274416 A1 Nov. 10, 2011

(30) Foreign Application Priority Data

May 6, 2010 (TW) ..... 99208410 U

(51) Int. Cl.
*F22B 29/06* (2006.01)

(52) U.S. Cl. ..... 392/397; 392/396; 392/465

(58) Field of Classification Search ..... None
See application file for complete search history.

(56) References Cited

U.S. PATENT DOCUMENTS 4,563,571 A * 1/1986 Koga et al. ..... 392/493
6,192,192 B1 * 2/2001 Illy et al. ..... 392/480
6,275,653 B1 * 8/2001 Montipo' ..... 392/405
8,180,207 B2 * 5/2012 Shirai et al. ..... 392/491
2006/0151458 A1 * 7/2006 Shirai et al. ..... 219/217

* cited by examiner

*Primary Examiner* — Thor Campbell
(74) *Attorney, Agent, or Firm* — Pai Patent & Trademark Law Firm; Chao-Chang David Pai

(57) ABSTRACT

A steam generator includes a body defining therein a flow passage having an inlet and an outlet, a heater installed in the body and adapted for heating water being guided through the inlet of the flow passage into the inside of the flow passage into steam for enabling generated steam to flow out of the outlet of the flow passage, and at least one friction unit mounted in the flow passage and movable by generated steam to rub against the inside wall of the flow passage and to remove water scale from the inside wall. Thus, the steam generator uses the friction unit to remove water scale from the inside wall of the flow passage during operation, avoiding water scale accumulation and prolonging the lifespan.

4 Claims, 4 Drawing Sheets

STEAM GENERATOR

BACKGROUND OF THE INVENTION

1. Field of the Invention

The present invention relates to steam generating apparatus and more particularly, to a steam generator, which automatically removes water scale.

2. Description of the Related Art

Electrical home appliances using steam to achieve a specific effect are commercially available, for example, steam mop, steam washing machine and steam iron commonly use a steam generator to boil water into steam for application.

A regular steam iron generally comprises a water reservoir and a panel-like steam generator. The steam generator comprises a flow passage, and a plurality of steam outlets spaced along the flow passage. When using the steam iron, water is guided from the water reservoir into the flow passage of the steam generator where water is heated into steam that flows out of the steam outlets for making clothes smooth and flat.

According to the aforesaid conventional design, the steam generator has a flow passage defined therein for supplying water and guiding generated steam. However, the inside wall of the flow passage tends to be covered with water scale. The amount of water scale accumulated in the flow passage will increase with time, lowering the flow rate of the flow passage and affecting the heating efficiency of the steam generator. Further, cleaning of the flow passage is not easy. When the steam generating efficiency of the steam generator becomes low due to water scale accumulation, the steam generator must be replaced. Replacing the steam generator increases the user's expenditure and causes inconvenience to the user.

SUMMARY OF THE INVENTION

The present invention has been accomplished under the circumstances in view. It is the main object of the present invention to provide a steam generator, which removes water scale automatically, avoiding water scale accumulation in the flow passage to affect steam generating performance, and prolonging steam generator lifespan.

To achieve this and other objects of the present invention, a steam generator comprises a body defining therein a flow passage having an inlet and an outlet, a heater installed in the body and adapted for heating water being guided through the inlet of the flow passage into the inside of the flow passage into steam for enabling generated steam to flow out of the outlet of the flow passage, and at least one friction unit mounted in the flow passage and movable by generated steam to rub against the inside wall of the flow passage and to remove water scale from the inside wall. Thus, the steam generator uses the friction unit to remove water scale from the inside wall of the flow passage during operation, avoiding water scale accumulation and prolonging the lifespan.

Other benefits, advantages and features of the present invention will be fully understood by reference to the following detailed description in conjunction with the accompanying drawings.

DETAILED DESCRIPTION OF THE INVENTION

Figure 1:
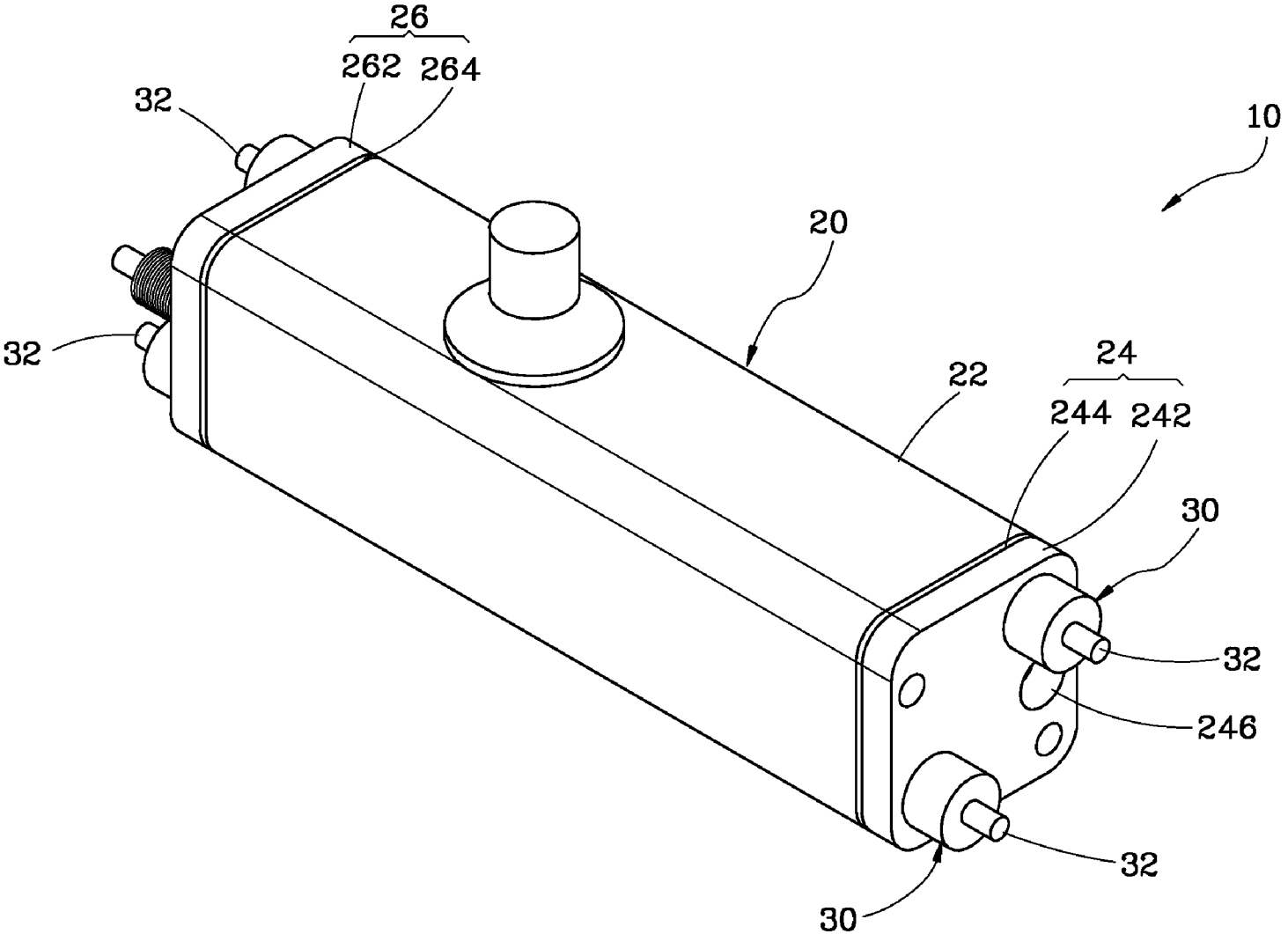
FIG. 1 is an elevational view of a steam generator in accordance with the present invention.
Figure 2:
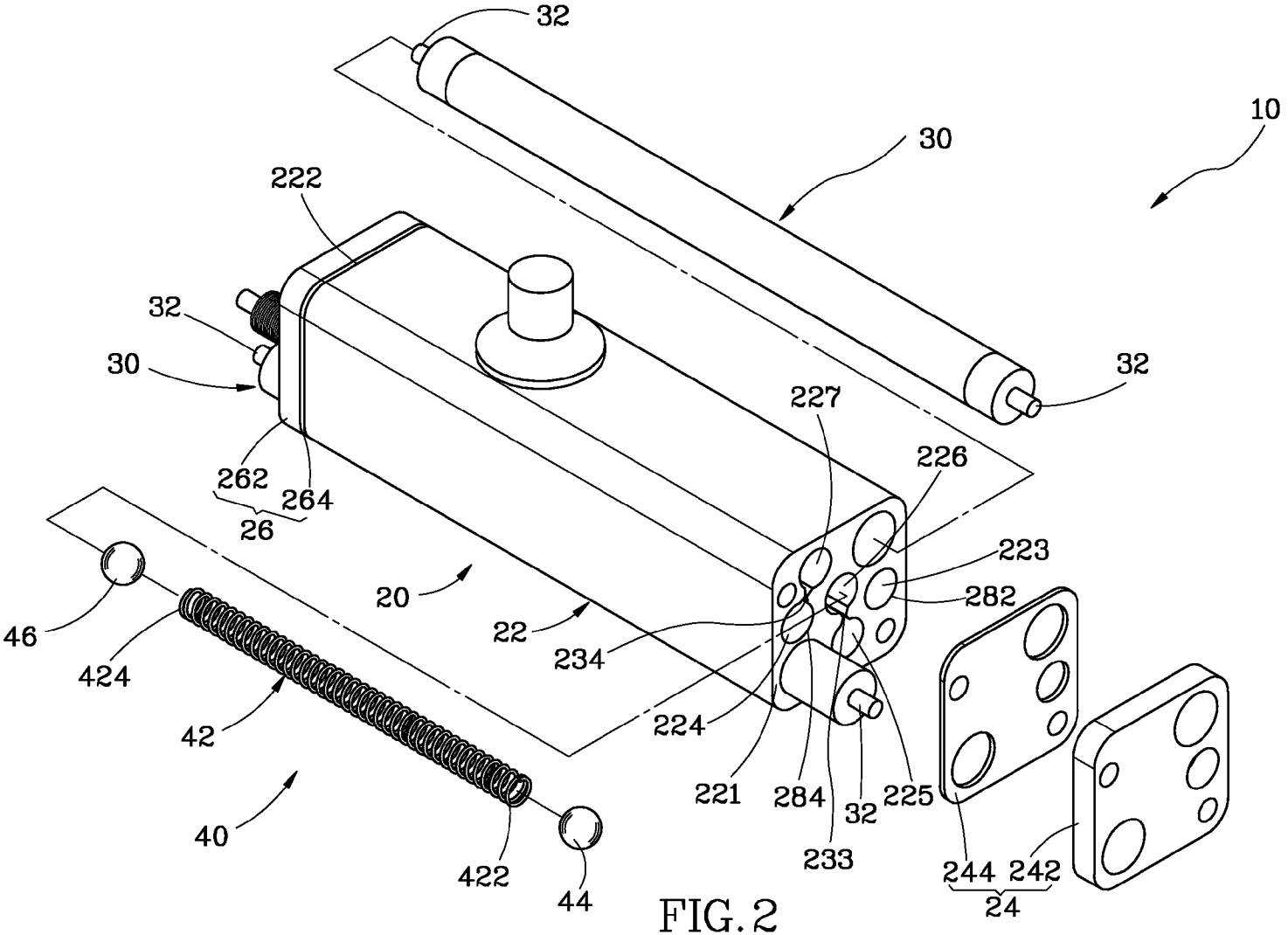
FIG. 2 is an exploded view of the steam generator in accordance with the present invention.
Figure 3:
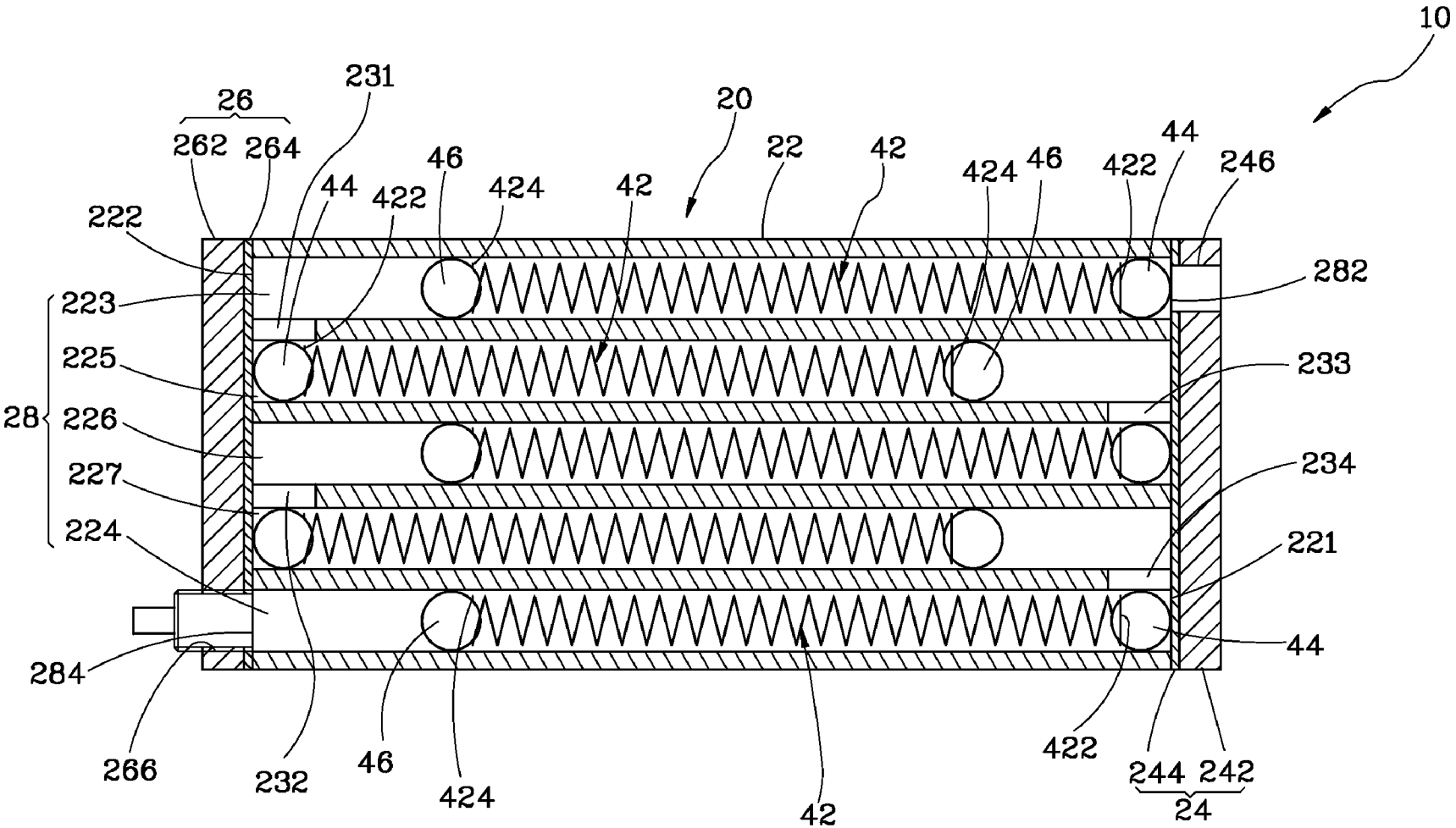
FIG. 3 is a sectional view of the present invention, showing the arrangement of the flow passage in the housing.

Referring to FIGS. 1-3, a steam generator 10 in accordance with the present invention is shown comprising a body 20, two heaters 30 and five friction units 40.

The body 20 comprises a base member 22, a first cover 24 and a second cover 26. The base member 22 is prepared from metal (for example, steel or copper) or any other material having high thermal conductivity. The base member 22 has opposing first end 221 and second end 222, and five through holes cutting through the first end 221 and the second end 222. These through holes include a water inlet 223, a steam outlet 224, a first receive hole 225, a second receive hole 226 and a third receive hole 227. The first cover 24 and the second cover 26 each comprise a cover body 242 or 262 and a gasket pad 244 or 264. The first cover 24 and the second cover 26 are respectively affixed to the first end 221 and second end 222 of the base member 22. The gasket pads 244 and 264 are respectively sandwiched between the cover bodies 242 and 262 and the base member 22. Thus, the first cover 24 seals the openings of the steam outlet 224, first receive hole 225, second receive hole 226 and third receive hole 227 at the first end 221 of the base member 22; the second cover 26 seals the openings of the water inlet 223, first receive hole 225, second receive hole 226 and third receive hole 227 at the second end 222 of the base member 22. Further, the first cover 24 has a first through hole 246 cut through the cover body 242 and gasket pad 244 thereof; the second cover 26 has a second through hole 266 cut through the cover body 262 and gasket pad 264 thereof. The water inlet 223 and the steam outlet 224 are connected to the outside of the body 20 through the first through hole 246 and the second through hole 266 respectively. As shown in FIG. 3, the water inlet 223 communicate with the first receive hole 225 by a slot 231 at the second end 222 of the base member 22; the second receive hole 226 communicate with the third receive hole 227 by a slot 232 at the second end 222 of the base member 22; the first receive hole 225 communicate with the second receive hole 226 by a slot 233 at the first end 221 of the base member 22; the steam outlet 224 communicate with the third receive hole 227 by a slot 234 at the first end 221 of the base member 22. Thus, the water inlet 223, the first, second and third receive holes 225, 226 and 227 and the steam outlet 224 are communicated in series, forming a flow passage 28 in the body 20, wherein the inlet 282 and outlet 284 of the flow passage 28 are the opening of the water inlet 223 at the first end 221 of the base member 22 and the opening of the steam outlet 224 at the second end 222 of the base member 22, and are respectively disposed in communication with the first through hole 246 of the first cover 24 and the second through hole 266 of the second cover 26.

The two heaters 30 are mounted in the body 20, each having two electrodes 32 respectively disposed outside the body 20 for connection to an external power source (not shown) for causing the heaters 30 to generate heat energy and to transmit generated heat energy to the body 20.

Figure 4:
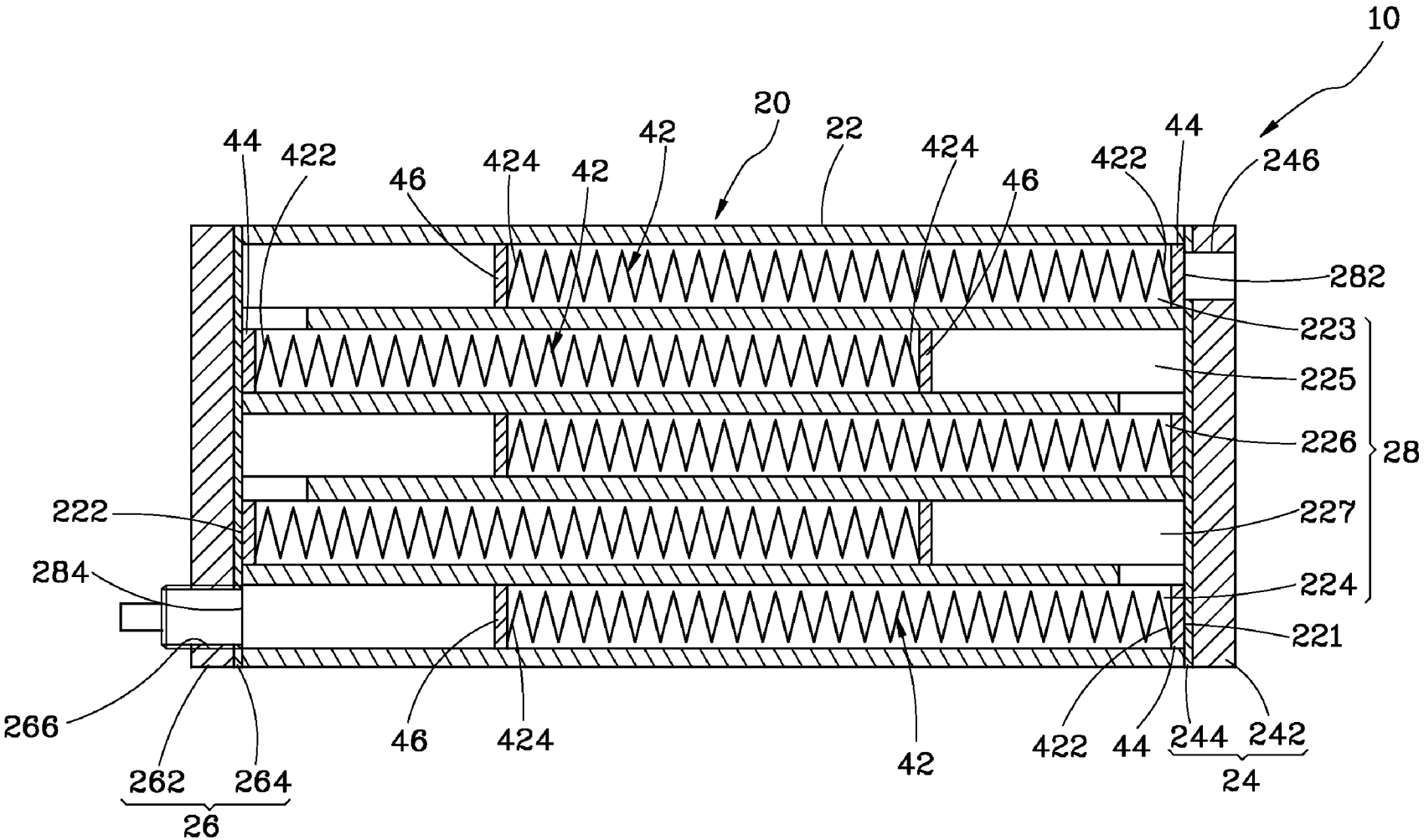
FIG. 4 is similar to FIG. 3, but showing a different shape of friction members used in the flow passage.

The five friction units 40 are respectively mounted in the water inlet 223, steam outlet 224, first receive hole 225, second receive hole 226 and third receive hole 227 of the base member 22, each comprising an elastic member 42, a first friction member 44 and a second friction member 46. The elastic member 42 is a compression spring, having a pressure-receiving end 422 and a pressure-releasing end 424. The first friction member 44 and the second friction member 46 are mounted on the pressure-receiving end 422 and pressure-releasing end 424 of the elastic member 42. The first friction member 44 and the second friction member 46 can be shaped like a ball (see FIG. 3) or flat panel (see FIG. 4), or made in any of a variety of other shapes that can be moved along the flow passage 28 and rubbed against the inside wall 286 of the flow passage 28 during movement.

During use of the steam generator 10, the heaters 30 are electrically connected, and water is guided into the inlet 282 of the flow passage 28. At this time, the heat energy generated by the heaters 30 is transmitted to the body 20 to heat water into steam. The pressure of the generated steam firstly pushes the first friction member 44 of the friction unit 40 in the water inlet 223 toward the pressure-releasing end 424 of the elastic member 42 and to further force the second friction member 46 against the close end of the water inlet 223 and compress the elastic member 42. The compressed elastic member 42 provides spring force of bouncing in direction from the pressure-releasing end 424 toward the pressure-receiving end 422, moving the first friction member 44 and the second friction member 46 in the same direction. Thereafter, the generated steam enters the first receive hole 225, the second receive hole 226, the third receive hole 227 and the steam outlet 224 in proper order to reciprocally push the respective friction units 40, and then flows out of the outlet 284 of the flow passage 28.

When the friction units 40 are being moved along the flow passage 28 during the aforesaid process, they are rubbed against the inside wall 286 of the flow passage 28 to remove water scale from the inside wall 286 of the flow passage 28, avoiding water scale accumulation in the steam generator 10 and prolonging the lifespan of the steam generator 10.

As described above, the major technical characteristic of the present invention is the use of the friction units 40 to remove water scale from the inside wall of the steam generator, i.e., the shape and composition of the flow passage can be substituted by other designs having the same effect.

Further, it is to be understood that the steam generator 10 of the invention can be used in any of a variety of electrical appliances that use steam to achieve a specific function, such as steam mop, steam washing machine, steam iron, etc. Further, to fit different electrical appliances that have different power rates and require different steam capacities, the size of the body and the number or length of the heaters and flow passage may be varied. For example, the flow passage 28 of the steam generator 10 can be made relatively longer for use in a steam iron. By means of increasing the dimension of the body 20 and the number of through holes of the base member 22, the flow passage 28 is relatively extended. For use in a mini steam iron, the flow passage 28 can be relatively shortened. By means of reducing the dimension of the body 20 and the number of through holes of the base member 22, the flow passage 28 is relatively shortened.

Although particular embodiments of the invention have been described in detail for purposes of illustration, various modifications and enhancements may be made without departing from the spirit and scope of the invention. Accordingly, the invention is not to be limited except as by the appended claims.

What is claimed is:

1. A steam generator, comprising:

a body, said body comprising a flow passage, said flow passage having an inlet and an outlet;

a heater installed in said body and adapted for heating water guided through the inlet of said flow passage into the inside of said flow passage into steam for enabling the steam to flow out of the outlet of said flow passage; and at least one friction unit mounted in said flow passage and movable by the steam to rub against the inside wall of said flow passage and to remove water scale from said inside wall, wherein each said friction unit comprises:

an elastic member having a pressure-receiving end and a pressure-releasing end; and a first friction member mounted on the pressure-receiving end of said elastic member and movable along said flow passage and adapted for rubbing against the inside wall of said flow passage when moving along said flow passage, said first friction member being movable by the steam in direction toward said pressure-releasing end.

2. The steam generator as claimed in claim 1, wherein each said friction unit further comprises a second friction member mounted on said pressure-releasing end of said elastic member and movable by said elastic member toward said pressure-receiving end to rub against the inside wall of said flow passage.

3. The steam generator as claimed in claim 1, wherein said body comprises:

a base member having opposing first end and second end and a plurality of through holes cutting through said first end and said second end, each said through hole accommodating one said friction unit, said through holes including:

at least one receive hole having two ends communicated with another one said through hole;

a water inlet having one end thereof communicated with one of said receive hole; and a steam outlet having one end thereof communicated with one of said receive hole;

a first cover affixed to the first end of said base member to seal the corresponding end of said steam outlet and the corresponding end of each said receive hole, said first cover having a first through hole in communication between said water inlet and the outside of said body; and a second cover affixed to the second end of said base member to seal the corresponding end of said water inlet and the corresponding end of each said receive hole, said second cover having a second through hole in communication between said steam outlet and the outside of said body;

wherein said water inlet, said at least one receive hole and said steam outlet are communicated in series to form said flow passage; the end of said water inlet at the first end of said base member forms the inlet of said flow passage; the end of said steam outlet at the second end of said base member forms the outlet of said flow passage.

4. The steam generator as claimed in claim 3, wherein said first cover and said second cover each comprise a cover body and a gasket pad sandwiched in between said cover body and said base member.

* * * * *